US008479706B2

(12) United States Patent
Speers et al.

(10) Patent No.: US 8,479,706 B2
(45) Date of Patent: Jul. 9, 2013

(54) METHOD AND SYSTEM FOR REGULATING EMISSIONS FROM IDLING MOTOR VEHICLES

(76) Inventors: James P. Speers, St. Albert (CA); Byung Woo Min, La Canada (CA)

( * ) Notice: Subject to any disclaimer, the term of this patent is extended or adjusted under 35 U.S.C. 154(b) by 404 days.

(21) Appl. No.: 12/696,511

(22) Filed: Jan. 29, 2010

(65) Prior Publication Data

US 2010/0186711 A1 Jul. 29, 2010

Related U.S. Application Data

(60) Provisional application No. 61/148,342, filed on Jan. 29, 2009.

(51) Int. Cl.
*F02D 41/08* (2006.01)
*F02D 41/00* (2006.01)

(52) U.S. Cl.
USPC ..... 123/339.14; 123/179.2

(58) Field of Classification Search
USPC ..... 123/339.14, 179.2, 339.15; 701/113, 701/36
See application file for complete search history.

(56) References Cited

U.S. PATENT DOCUMENTS 4,345,554 A 8/1982 Hildreth et al.
4,577,599 A 3/1986 Chmielewski
5,024,186 A 6/1991 Long et al.
5,042,439 A * 8/1991 Tholl et al. ..... 123/179.2
5,349,931 A 9/1994 Gottlieb et al.
5,942,988 A 8/1999 Snyder et al.
6,812,829 B1 11/2004 Flick
7,650,864 B2 1/2010 Hassan et al.
2003/0222758 A1 * 12/2003 Willats et al. ..... 340/5.72
2005/0225175 A1 * 10/2005 Maehara et al. ..... 307/10.1
2008/0117079 A1 * 5/2008 Hassan ..... 340/901

* cited by examiner

*Primary Examiner* — Mahmoud Gimie
(74) *Attorney, Agent, or Firm* — Donald V. Tomkins

(57) ABSTRACT

A system for regulating the operation of an idling motor vehicle monitors one or more selected engine operational parameters such as coolant temperature, exhaust gas temperature, and catalytic converter temperature, and compares the measured parameters against selected benchmark criteria stored in the memory of a microprocessor. The microprocessor controls the vehicle's ignition system to shut down the engine when the measured parameters come within the corresponding benchmark criteria. The system preferably but not necessarily operates in conjunction with a remote vehicle starter system. The system may also or alternatively be adapted to shut down an idling motor vehicle engine when total idling time reaches a specified maximum value, which may be selected based on idling time restriction bylaws. Accordingly, the system promotes reduced fuel consumption and mitigates environmental impacts by automatically regulating vehicle idling times, while also facilitating avoidance of idling time restriction bylaw violations.

12 Claims, 3 Drawing Sheets

METHOD AND SYSTEM FOR REGULATING EMISSIONS FROM IDLING MOTOR VEHICLES

CROSS-REFERENCE TO RELATED APPLICATIONS

This application claims the benefit, pursuant to 35 U.S.C. 119(e), of U.S. Provisional Application No. 61/148,342, filed on Jan. 29, 2009, and said provisional application is incorporated herein by reference in its entirety to provide continuity of disclosure.

FIELD OF THE INVENTION

The present invention relates in general to methods and systems for regulating and reducing exhaust emissions from idling motor vehicles, and in particular to such methods and systems associated with remote motor vehicle starter systems.

BACKGROUND OF THE INVENTION

Remote vehicles starters for motor vehicles have been available in the market since the 1980s. A typical conventional remote starter system incorporates a microprocessor pre-programmed to receive RF (i.e., radio frequency) signals from a remote key fob via an internal or external RF circuit. The remote starter system interfaces with a motor vehicle via various transistors, relays, and data outputs, plus a variety of control inputs and external sensors. During the evolution of remote starter systems, there have been a number of technological advancements for these devices. Some of these advancements have included communication to the motor vehicle via the vehicle's data bus.

Examples of prior art remote starter systems may be seen in the following patent documents:

U.S. Pat. No. 4,345,554 (Hildreth et al.);
U.S. Pat. No. 4,577,599 (Chmielewski);
U.S. Pat. No. 5,024,186 (Long et al.);
U.S. Pat. No. 5,349,931 (Gottlieb et al.);
U.S. Pat. No. 5,942,988 (Snyder et al.);
U.S. Pat. No. 6,812,829 (Flick); and
U.S. Pat. No. 7,650,864 (Hassan et al.).

The current and growing concern for the environment has promoted a demand for reduced fuel consumption and exhaust emissions by motor vehicles. These concerns have led an increasing number of jurisdictions to consider or implement anti-idling laws as a step toward reducing atmospheric pollution from motor vehicles, to discourage excess idling to keep a car's interior warm in cold weather or cool in hot weather. For example, the city of St. Albert, Alberta. Canada passed an "Idle-Free Bylaw" in March of 2008, prohibiting vehicle idling for more than three minutes during any 30-minute period when the outside temperature is between zero degrees Celsius (32 degrees Fahrenheit) and 30 degrees C. (86 degrees F.). Under a similar bylaw in Toronto, Ontario, idling of a motor vehicle (or a boat) must not exceed three minutes in a given 60-minute period when the outside temperature is between 5 degrees C. (41 degrees F.) and 27 degrees C. (80 degrees F.).

Known types of remote vehicle starters have proved not conducive to the desirable objectives of reduced fuel consumption and exhaust emissions, because they encourage or make it easy for people to let the engines of their vehicles idle, whether intentionally or unintentionally, long after the engines are adequately warmed up and ready to drive, and after their vehicle interiors have warmed (or cooled) to a comfortable temperature. In addition to creating or aggravating environmental concerns, this practice has become increasingly likely to constitute a breach of municipal bylaws, leading to the imposition of fines.

For these reasons, there is a need for methods and systems for reducing motor vehicle exhaust emissions (and, in turn, reducing fuel consumption) by allowing a vehicle to idle only long enough to reach a condition of environmentally optimal operability, in accordance with selected environmental and operational criteria, particularly but not exclusively in association with remote vehicle starter systems. In addition, there is a need for such methods and systems that can be programmed to prevent the breach of laws that restrict the duration of vehicle idling, particularly but not exclusively in association with remote vehicle starter systems. The present invention is directed to these needs.

BRIEF SUMMARY OF THE INVENTION

In general terms, the present invention provides systems and methods for regulating exhaust emissions from an idling motor vehicle, including but not restricted to motor vehicles started using a remote vehicle starter system, in response to data inputs from environmental sensors and/or engine operational state sensors. In a first aspect, the invention provides a system adapted to monitor one or more selected parameters (or "active inputs") such as outside air temperature, inside air temperature, engine temperature, engine exhaust gas temperature, and catalytic converter temperature (as measured by suitable sensors), or a selected combination of these and/or other factors. The system compares the monitored active inputs against one or more sets of pre-defined benchmark values, or ranges of benchmark values, stored as "look-up tables" in memory in a microprocessor associated with a motor vehicle or associated with a remote starter system. The stored benchmark values define one or more engine operational states optimal for particular environmental conditions. For example, the optimal set of benchmark values may be different for different outside temperatures, in which case the system will determine the applicable set of benchmark values based on outside temperature inputs.

Based on the comparison of monitored engine operational parameters against the applicable benchmark values stored in memory, the microprocessor controls the vehicle's ignition system so as to regulate the engine idling time after starting, by shutting off the vehicle's engine after one or more selected active inputs have reached corresponding benchmark values, or have come within corresponding ranges of benchmark values.

It is well established that the amount of environmentally harmful emissions produced by a gasoline or diesel engine is reduced when optimal engine operating conditions have been achieved. Systems in accordance with the present invention may be adapted to automatically shut down an idling engine when selected engine operational parameters reach pre-defined levels corresponding to an optimal operational state. Once this state has been reached, there is no practical need for the engine to continue idling because further idling is merely wasting fuel and generating more exhaust emissions without enhancing the operational status of the engine appreciably or at all. Accordingly, the methods and systems of the present invention reduce fuel wastage and environmental impacts that would otherwise occur due to excessive idling. Optionally, the methods and systems may also facilitate Optimization of driver and passenger comfort in terms of interior vehicle temperature conditions.

Accordingly, in a first embodiment the present invention provides a system for regulating the operation of an idling motor vehicle engine, comprising: an engine control module having a microprocessor and a microprocessor memory, with the engine control module being operative to deactivate a motor vehicle's ignition system in response to an engine shutdown signal from the microprocessor. The system includes one or more engine sensors adapted to measure selected engine operational parameters and to send corresponding engine sensor input values to the engine control module. The microprocessor memory is adaptable to store a selected benchmark values for the operational parameters measured by the one or more engine sensors. The microprocessor is programmed to compare engine sensor input values against the stored benchmark values, and to generate an engine shutdown signal when all engine sensor input values equal or exceed corresponding benchmark values.

In a second aspect, the present invention provides a remote starter system that is programmable to shut down an idling vehicle engine when the total idling time reaches or exceeds pre-set idling time limits, thereby further reducing fuel wastage and greenhouse gas emissions. This feature enables a vehicle owner or operator to avoid breach of anti-idling bylaws, by programming specific anti-idling bylaw criteria into the remote starter system's microprocessor memory. For the typical case where an anti-idling bylaw applies only when the outside air temperature is above a lower benchmark and below an upper benchmark, the system may be operative to shut down the engine only when the outside air temperature is between the lower and upper temperature benchmarks. In preferred embodiments, the system will be adapted to generate an electronic record of idling times and outside air temperatures for purposes of providing evidence of anti-idling bylaw compliance should the need arise.

Accordingly, in a second embodiment the present invention provides a system for regulating the operation of an idling motor vehicle engine, comprising an engine control module having a microprocessor and a microprocessor memory, with the engine control module being operative to deactivate a motor vehicle's ignition system in response to an engine shutdown signal from the microprocessor. The microprocessor includes clock means, and is adapted to automatically activate the clock means upon start-up of the motor vehicle engine and to monitor the engine's running time. The microprocessor memory is adaptable to store selected idling time restriction criteria including a maximum idling time. The microprocessor is programmed to generate an engine shutdown signal when the engine's running time equals or exceeds the maximum idling time.

In alternative embodiments, systems in accordance with the present invention may combine the features of the first and second embodiments described above.

In further aspects, the present invention teaches methods for regulating the operation of an idling motor vehicle engine, in accordance with the general operational principles of the described and illustrated system embodiments.

BRIEF DESCRIPTION OF THE DRAWINGS

Embodiments of the present invention will now be described with reference to the accompanying figures, in which numerical references denote like parts, and in which.

DETAILED DESCRIPTION OF THE PREFERRED EMBODIMENTS

Figure 1:
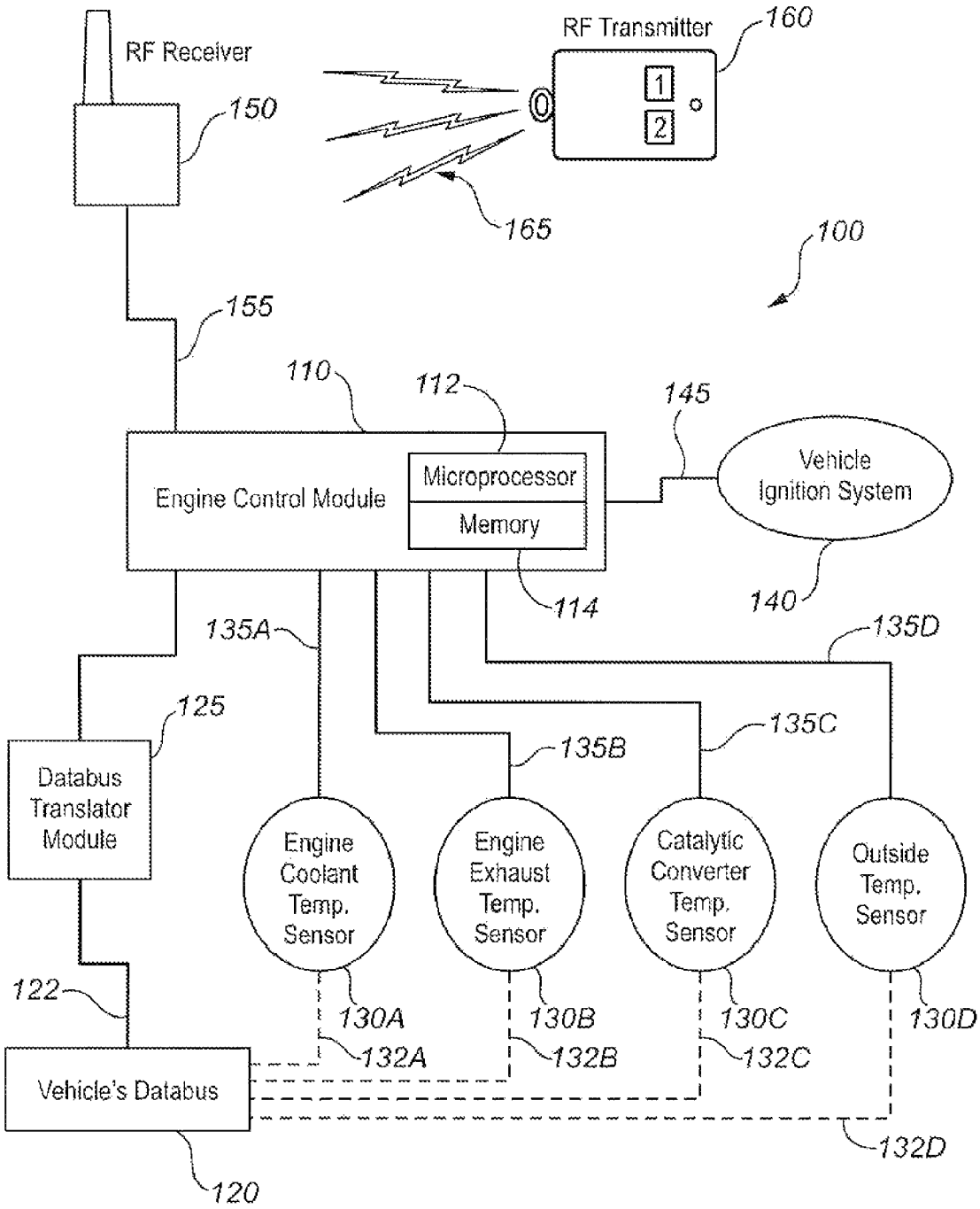
FIG. 1 is a schematic diagram of the components of an engine regulation system in accordance with a first embodiment of the present invention.

FIG. 1 schematically illustrates the components of an engine regulation system 100 for regulating motor vehicle exhaust emissions in accordance with a first embodiment of the present invention. System 100 comprises engine control module 110 incorporating a microprocessor 112 and a microprocessor memory 114. Control module 110 is in direct electronic communication with one or more sensors 130A, 130B, 130C (and so on), via corresponding sensor data links 135A, 135B, 135C (and so on). Alternatively, control module 110 may be in electronic communication with sensors 135A, 135B, 135C (and so on) via a data bus 120, with which the sensors communicate which via corresponding sensor data links 132A, 132B, 132C (and so on). Sensor data links could be wired or wireless links. Data bus 120 is in communication with control module 110 via a communication link 122 (possibly but not necessarily in association with a data bus translator module 125 as shown in FIG. 1).

The particular embodiment of system 100 illustrated in FIG. 1 incorporates an engine coolant temperature sensor 130A, an engine exhaust temperature sensor 130B, a catalytic converter temperature sensor 130C, and an outside temperature sensor 130D. However, this is by way of example only; any one or more other sensors (including but not limited to a vehicle interior temperature sensor) could be used in addition to or in substitution for any one or more of the sensors illustrated in FIG. 1.

As indicated in FIG. 1, control module 110 is operatively connected to the ignition system 140 of a motor vehicle, such as via the vehicle's wiring harness or other suitable electrical or electronic linkage represented by reference number 145. Control module 110 is thus operative to engage or disengage ignition system 140 in response to various control signals that may be generated in accordance with the present invention, as will he described in greater detail later in this document.

In the preferred embodiment shown in FIG. 1, control module 110 is provided in association with an RF receiver 150 for receiving RF control signals 165 from a remote RF transmitter 160 housed in a remote starter control device, which can he provided in any suitable form (including, but not limited to, a conventional remote control device, key fob, cellular telephone, computer, automatic timer, or temperature-activated control device). In alternative embodiments, however, system 100 and control module 110 are operable in association with vehicles that do not use a remote starter system and are instead started with an ignition key.

Figure 2:
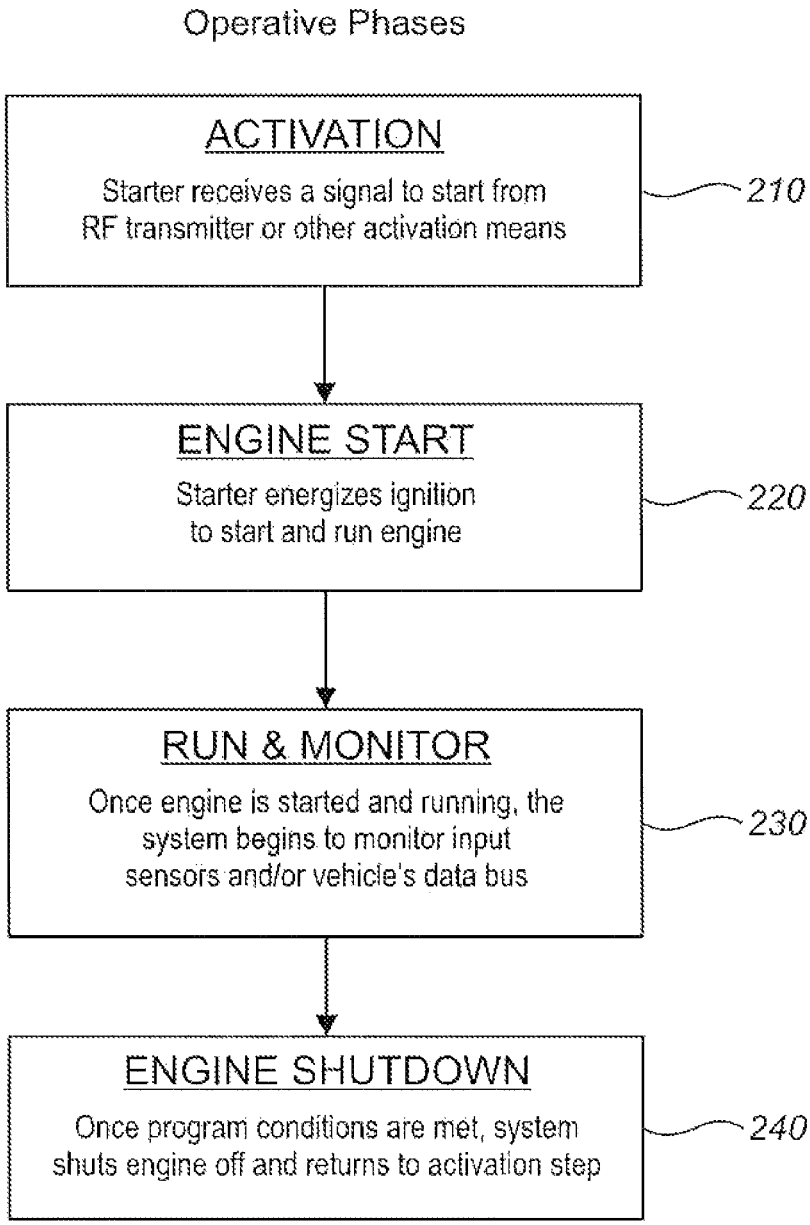
FIG. 2 is a flow chart of the operative phases of an engine regulation system in accordance with a second embodiment of the invention.

FIG. 2 is a flow chart schematically illustrating the operative phases of an engine regulation system 100 in accordance a second embodiment of the present invention. In the "Activation" phase 210, control module 110 receives a signal from RF transmitter 160 (or other activation means) to initiate start-up of the vehicle's engine. In the "Engine Start" phase 220, control module 110 engages ignition system 140 to start the motor. In the "Run & Monitor" phase 230, which begins as soon as the engine is running, control module 110 monitors "active inputs" from sensors 130A, 130B, etc., and compares these inputs against benchmark values stored in memory 114. Once all monitored active inputs have reached their corresponding benchmark values, microprocessor 112 generates an engine shutdown signal which control module 110 transmits to ignition system 140, which is thereby deactivated and the engine is shut down.

Figure 3:
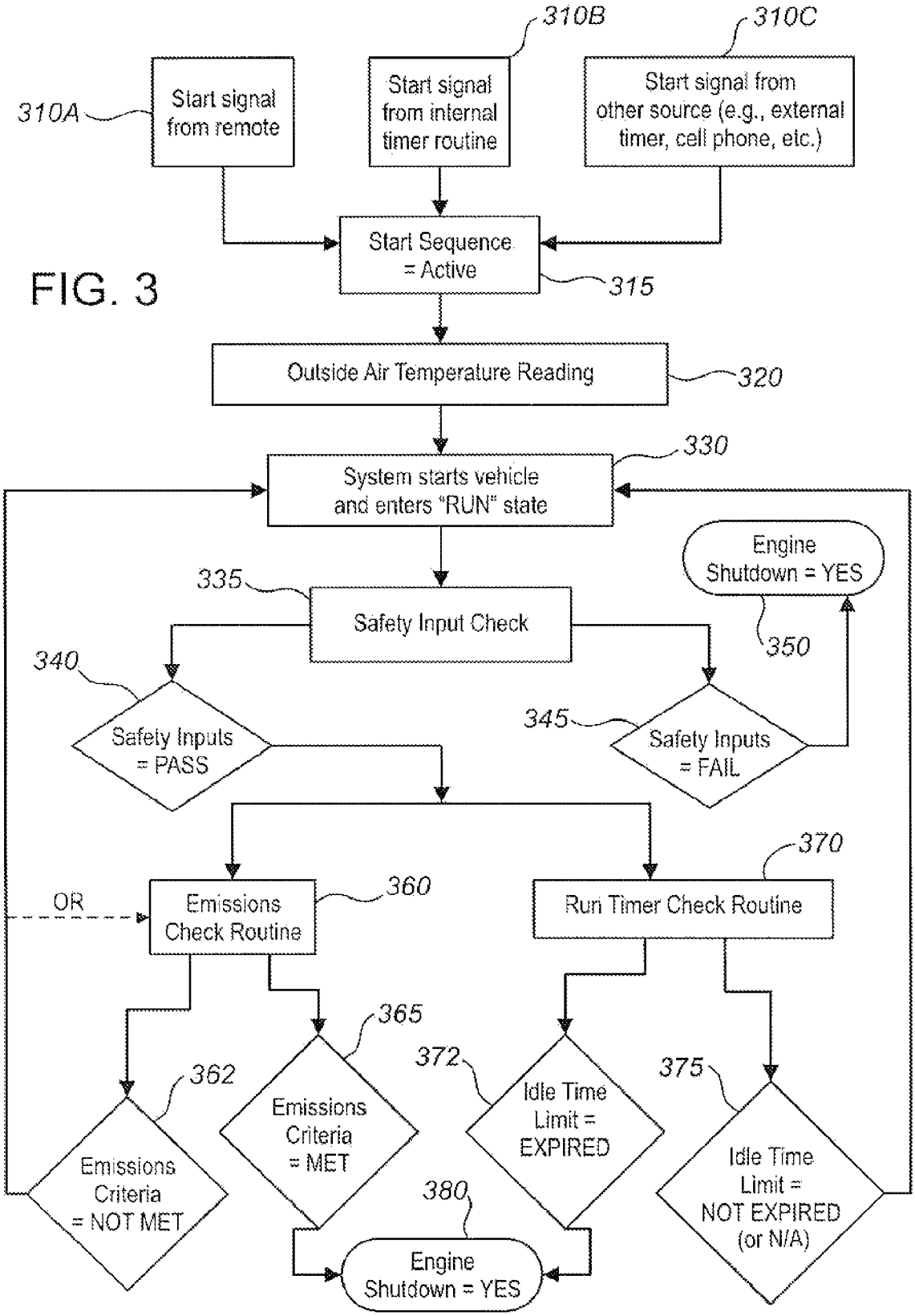
FIG. 3 is a program logic diagram for an engine regulation system in accordance with a third embodiment of the invention.

Engine regulation systems and methods in accordance with the present invention may be adapted for use with input data from many types of sensors, and for a variety of purposes, which may be user-defined and user-programmable, or pre-programmed into control module 110. By way of example, FIG. 3 illustrates a program logic diagram for an embodiment of control module 110 that is adapted for two particular purposes. The first purpose is to balance the desirable objective of letting an engine warm up for a sufficient length of time to achieve an optimal operational state with the further objective of minimizing the length of time that the engine is idling and thus generating exhaust emissions. The second purpose is to provide automatic regulation of engine idling time to prevent inadvertent violation of bylaws that restrict the length of time that a motor vehicle engine is allowed to idle.

As schematically depicted in FIG. 3, an engine start sequence 315 is initiated when control module 110 receives a start signal from a start-up activation means, which could be provided in any of several forms including a remote starting system 310A, an internal timer 310B, or other activation means 310C (which could include a conventional key start). At program stage 320, an outside air temperature reading is taken by means of sensor 130D (not shown in FIG. 3), and this reading is stored in memory 114 for later use as will be explained. At program stage 330, control module 110 activates ignition system 140 (not shown in FIG. 3) to start the engine and the program enters a "RUN" state.

At this point, microprocessor 112 then runs a "Safety Input Check" routine 335, intended to prevent activation of the vehicle's starter, or to shut down the engine if it has been started, in the event that one or more selected safety conditions have not been met. Such safety conditions may include (without being limited to) an unlatched engine hood, a parking brake or transmission lock not properly engaged, and a manual transmission not in neutral. Such conditions can be detected using built-in or after-market sensors or similar devices, the readings from which May be accessed by direct connection to control module 110 or via the data bus 120.

If the "Safety Input Check" routine 335 determines that the state of any of these items is not sale for vehicle operation, control module 110 will generate a safety inputs "FAIL" signal 345 which initiate engine shutdown (as indicated by reference number 350). However, if all safety inputs "PASS" (as indicated by reference number 340), microprocessor 112 moves on to an "Emissions Check" routine 360 and a "Run Time Check" routine 370.

In the "Emissions Check" routine 360, microprocessor 112 compares readings or "active inputs" from selected engine sensors (such as engine coolant temperature sensor 130A, an engine exhaust temperature sensor 130B, a catalytic converter temperature sensor 130C, all as shown in FIG. 1) against a set of corresponding benchmark values stored in memory 114. The appropriate set of benchmark values for a given set of active inputs, for purposes of a particular optimal engine operational state, will commonly vary according to environmental conditions such as outside air temperature. Accordingly. memory 114 may store multiple sets of benchmark values for a particular optimial state, with each set of benchmark values being correlated to a particular outside air temperature range. In this case, microprocessor 112 will use the outside air temperature reading from program stage 320 to determine and select the appropriate set of benchmark values for comparison purposes.

If microprocessor 112 determines that all active inputs meet the applicable benchmark criteria (as indicated by reference number 365), control module 110 Will shut down the engine (as indicted by reference number 380). However, if one or more active inputs do not yet meet the applicable benchmark values or ranges (as indicated by reference number), the System will loop back to program stage 330 or, alternatively, to program stage 360. The system will run the "Emissions Check" routine 360 on an iterative basis until the "criteria met" stage 365 is achieved and the engine is shut down, or until the "Emissions Check" routine 360 is overridden by the "Run Timer Check" routine 370, as described below.

The "Run Timer Check" routine 370 may be programmed in a variety of ways. In a simple case, "Run Timer Check" routine 370 could simply compare the elapsed idle time since engine start-up (as monitored by, for example, suitable clock means incorporated into microprocessor 112) against an arbitrary maximum idle time stored in memory 114. In the particular case where it is an objective to provide automatic protection against violation of an anti-idling bylaw, the relevant bylaw criteria will be programmed into memory 114. For example, the previously mentioned "Idle-Free Bylaw" in force in St. Albert, Alberta prohibits the idling of a motor vehicle for more than three minutes during any 30-minute period when the outside temperature is between zero and 30 degrees Celsius. These criteria would be stored in memory 114, and "Run Timer Check" routine 370 would make following inquiries:

1. Is the measured outside air temperature between zero and 30 degrees Celsius? If NO, the bylaw restrictions would not be in force, and the system would proceed to program stage 375 (i.e., Idle Time Limit not expired, or not applicable), and then loop back to program stage 330.
2. If the answer to question 1 is YES, has the engine been idling for more than three minutes? If NO, loop back to program stage 330.
3. If the answer to question 2 is YES, go to program stage 372 (i.e., Idle Time Limit expired) and Engine Shutdown 380.

The "Run Timer Check" routine 370 will of course be overridden by the "Emissions Check" routine 360 if the engine achieves the selected optimal operational state the Idle Time Limit has expired.

Optionally, the "Run Timer Check" routine 370 could be set up for automatic engine re-start 30 minutes after the last engine shutdown.

It is to be appreciated that FIG. 3 illustrates only one particular embodiment of the invention, and many variations are possible. For example, the "Safety Input Check" routine 335 is optional, and may not be provided in some embodiments. In such cases, program operation would proceed directly from program stage 330 to "Emissions Check" routine 360 and "Run Timer Check" routine 370 as described above. Other alternative embodiments could incorporate "Emissions Check" routine 360 but not "Run Timer Check" routine 370, or vice versa. As well, the outside air temperature reading could be taken at a different stage of the program from that shown in FIG. 3.

Although the invention has been described and illustrated in association with particular types of data sensors and for specific operational reasons (e.g., to limit engine warm-up time to the minimum required for the engine to reach an optimal operational state; and/or to limit engine idling time to avoid breach of anti-idling bylaws), it is to be understood that the invention is not restricted to usage for a limited number or type of purposes, nor is it limited to embodiments that use the particular types of sensors and active inputs referred to in this patent document.

Systems in accordance with the present invention may include a vehicle motion sensor adapted to send a vehicle motion signal to the engine control module upon detecting that the motor vehicle has been put into motion. In such variants, the engine control module is adapted to enter an inactive state upon receipt of a vehicle motion signal.

It will be readily appreciated by those skilled in the art that various modifications of the present invention may be devised without departing from the scope and teaching of the present invention, including modifications that use equivalent structures or materials hereafter conceived or developed. It is to he especially understood that the invention is not intended to be limited to any described or illustrated embodiment, and that the substitution of a variant of a claimed element or feature, without any substantial resultant change in the working of the invention, will not constitute a departure from the scope of the invention. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure.

What is claimed is:

1. A system for regulating operation of an idling motor vehicle engine, said system comprising:

(a) an engine control module having a microprocessor and a microprocessor memory, said engine control module being operative to deactivate a motor vehicle's ignition system in response to an engine shutdown signal from the microprocessor;

(b) one or more engine sensors, each engine sensor being adapted to measure a selected engine operational parameter and to send corresponding engine sensor input values to the engine control module;

(c) a vehicle motion sensor adapted to send a vehicle motion signal to the engine control module upon detecting that the motor vehicle has been put into motion, and wherein the engine control module is adapted to enter an inactive state upon receipt of a vehicle motion signal; and (d) an outside air temperature sensor adapted to measure the air temperature outside the motor vehicle and to send corresponding outside air temperature signals to the engine control module;

wherein:

(e) the microprocessor memory is adaptable to store selected benchmark values for the operational parameters measured by the one or more engine sensors;

(f) the microprocessor is programmed to compare engine sensor input values against the stored benchmark values, and to generate an engine shutdown signal when all engine sensor input values equal or exceed corresponding benchmark values; and (g) the microprocessor is programmed to generate an engine shutdown signal only when the measured outside air temperature is within a selected range.

2. A system as in claim 1 wherein the one or more engine operational parameters are selected from the group consisting of engine coolant temperature, engine exhaust temperature, and catalytic converter temperature.

3. A system as in claim 1, wherein:

(a) the microprocessor further comprises clock means, and is adapted to automatically activate the clock means upon start-up of the motor vehicle engine and to monitor the engine's running time;

(b) the microprocessor memory is adaptable to store selected idling time restriction criteria including a maximum idling time; and (c) the microprocessor is programmed to generate an engine shutdown signal when the engine's running time equals or exceeds the maximum idling time.

4. A system as in claim 1 wherein the engine control module is associated with a remote engine vehicle starter system.

5. A system for regulating operation of an idling motor vehicle engine, said system comprising:

(a) an engine control module having a microprocessor and a microprocessor memory, said engine control module being operative to deactivate a motor vehicle's ignition system in response to an engine shutdown signal from the microprocessor;

(b) one or more engine sensors, each engine sensor being adapted to measure a selected engine operational parameter and to send corresponding engine sensor input values to the engine control module;

(c) a vehicle motion sensor adapted to send a vehicle motion signal to the engine control module upon detecting that the motor vehicle has been put into motion, and wherein the engine control module is adapted to enter an inactive state upon receipt of a vehicle motion signal; and (d) an outside air temperature sensor adapted to measure the air temperature outside the motor vehicle and to send corresponding outside air temperature signals to the engine control module;

wherein:

(e) the microprocessor memory is adaptable to store selected benchmark values for the operational parameters measured by the one or more engine sensors;

(f) the microprocessor is programmed to compare engine sensor input values against the stored benchmark values, and to generate an engine shutdown signal when all engine sensor input values equal or exceed corresponding benchmark values;

(g) the idling time restriction criteria include upper and lower outside air temperature values defining an operative temperature range;

(h) the microprocessor is programmed to generate an engine shutdown signal when the engine's running time equals or exceeds the maximum idling time only when the measured outside air temperature is within said operative temperature range;

(i) the microprocessor further comprises clock means, and is adapted to automatically activate the clock means upon start-up of the motor vehicle engine and to monitor the engine's running time;

(j) the microprocessor memory is adaptable to store selected idling time restriction criteria including a maximum idling time; and (k) the microprocessor is programmed to generate an engine shutdown signal when the engine's running time equals or exceeds the maximum idling time.

6. A system for regulating operation of an idling motor vehicle engine, said system comprising:

(a) an engine control module having a microprocessor and a microprocessor memory; and (b) an outside air temperature sensor adapted to measure the air temperature outside the motor vehicle and to send corresponding outside air temperature signals to the engine control module;

wherein:

(c) the engine control module is operative to deactivate a motor vehicle's ignition system in response to an engine shutdown signal from the microprocessor;

(d) the microprocessor comprises clock means, and is adapted to automatically activate the clock means upon start-up of the motor vehicle engine and to monitor the engine's running time;

(e) the microprocessor memory is adaptable to store selected idling time restriction criteria including a maximum idling time;

(f) the microprocessor is programmed to generate an engine shutdown signal when the engine's running time equals or exceeds the maximum idling time;

(g) a vehicle motion sensor adapted to send a vehicle motion signal to the engine control module upon detecting that the motor vehicle has been put into motion, and wherein the engine control module is adapted to enter an inactive state upon receipt of a vehicle motion signal;

(h) the idling time restriction criteria include upper and lower outside air temperature values defining an operative temperature range; and (i) the microprocessor is programmed to generate an engine shutdown signal when the engine's running time equals or exceeds the maximum idling time only when the measured outside air temperature is within said operative temperature range.

7. A system as in claim 6 wherein the engine control module is associated with a remote engine vehicle starter system.

8. A method for regulating the operation of an idling motor vehicle engine, said method comprising the steps of:

(a) providing an engine control module having a microprocessor and a microprocessor memory, said engine control module being operative to deactivate a motor vehicle's ignition system in response to an engine shutdown signal from the microprocessor;

(b) providing one or more engine sensors, each engine sensor being adapted to measure a selected engine operational parameter and to send corresponding engine sensor input values to the engine control module;

(c) providing a vehicle motion sensor adapted to send a vehicle motion signal to the engine control module upon detecting that the motor vehicle has been put into motion, and wherein the engine control module is adapted to enter an inactive state upon receipt of a vehicle motion signal; and (d) providing an outside air temperature sensor adapted to measure the air temperature outside the motor vehicle and to send corresponding outside air temperature signals to the engine control module;

wherein:

(e) the microprocessor memory is adaptable to store selected benchmark values for the operational parameters measured by the one or more engine sensors;

(f) the microprocessor is programmed to compare engine sensor input values against the stored benchmark values, and to generate an engine shutdown signal when all engine sensor input values equal or exceed corresponding benchmark values; and (g) the microprocessor is programmed to generate an engine shutdown signal only when the measured outside air temperature is within a selected range.

9. A method as in claim 8 wherein the one or more engine operational parameters are selected from the group consisting of engine coolant temperature, engine exhaust temperature, and catalytic converter temperature.

10. A method as in claim 8, wherein:

(a) the microprocessor further comprises clock means, and is adapted to automatically activate the clock means upon start-up of the motor vehicle engine and to monitor the engine's running time;

(b) the microprocessor memory is adaptable to store selected idling time restriction criteria including a maximum idling time; and (c) the microprocessor is programmed to generate an engine shutdown signal when the engine's running time equals or exceeds the maximum idling time.

11. A method as in claim 10, comprising the further step of providing an outside air temperature sensor adapted to measure the air temperature outside the motor vehicle and to send corresponding outside air temperature signals to the engine control module, and wherein:

(a) the idling time restriction criteria include upper and lower outside air temperature values defining an operative temperature range; and (b) the microprocessor is programmed to generate an engine shutdown signal when the engine's running time equals or exceeds the maximum idling time only when the measured outside air temperature is within said operative temperature range.

12. A method as in claim 8 wherein the engine control module is associated with a remote engine vehicle starter system.

* * * * *